US007000386B1

(12) United States Patent
Morgan

(10) Patent No.: US 7,000,386 B1
(45) Date of Patent: Feb. 21, 2006

(54) HYDRAULIC INTENSIFICATION CIRCUIT WITH ROTARY FLOW DEVIDER AND BYPASS VALVE

(76) Inventor: George H. Morgan, 401 Tyler Ave., Evansville, IN (US) 47715-3243

( * ) Notice: Subject to any disclaimer, the term of this patent is extended or adjusted under 35 U.S.C. 154(b) by 316 days.

(21) Appl. No.: 10/656,565

(22) Filed: Sep. 5, 2003

Related U.S. Application Data

(60) Provisional application No. 60/433,427, filed on Dec. 12, 2002, provisional application No. 60/433,479, filed on Dec. 13, 2002.

(51) Int. Cl.
*F16D 31/02* (2006.01)

(52) U.S. Cl. ..... 60/419; 60/489

(58) Field of Classification Search ..... 60/419, 60/429, 462, 489
See application file for complete search history.

(56) References Cited

U.S. PATENT DOCUMENTS

| | | | | |
|---|---|---|---|---|
| 3,962,954 A * | 6/1976 | Jacob et al. | ..... | 60/486 |
| 4,102,425 A * | 7/1978 | Marsden et al. | ..... | 60/468 |
| 5,319,932 A * | 6/1994 | Roche | ..... | 60/419 |
| 5,511,368 A * | 4/1996 | Kocher | ..... | 56/15.2 |
| 6,279,317 B1 * | 8/2001 | Morgan | ..... | 60/488 |
| 6,438,951 B1 * | 8/2002 | Morgan | ..... | 60/419 |

* cited by examiner

*Primary Examiner*—Edward K. Look
*Assistant Examiner*—Michael Leslie
(74) *Attorney, Agent, or Firm*—Gary K. Price; Mark A. Manley; George H. Morgan

(57) ABSTRACT

A hydraulic drive circuit comprises a source of fluid flow, at least one hydraulic actuator and a rotary flow divider which operates in conjunction with valve means to provide intensified flow to the at least one hydraulic actuator.

5 Claims, 4 Drawing Sheets

HYDRAULIC INTENSIFICATION CIRCUIT WITH ROTARY FLOW DEVIDER AND BYPASS VALVE

CROSS REFERENCES TO RELATED APPLICATIONS

Provisional Application for Patent No. 60/433,427, filed Dec. 12, 2002, with the same title, "Hydraulic Intensification Circuit With Rotary Flow Divider and Bypass Valve", which is hereby incorporated by reference. Applicant claims priority pursuant to 35 U.S.C. Par. 119(e)i).

Provisional Application for Patent No. 60/433,479, filed Dec. 13, 2002, with the same title, "Hydraulic Intensification Circuit With Rotary Flow Divider and Bypass Valve", which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not applicable.

BACKGROUND OF THE INVENTION

1. Field of the Invention

This invention relates to a hydraulic intensification circuit using a rotary flow divider with a bypass valve.

2. Background Information

Hydraulic systems are popular in applications involving hazardous, dirty, and nasty environments, such as coal mines, quarries, food processing plants, and construction sites. Much effort has been expended in trying to increase the efficiency and performance ranges of hydraulic systems.

Intensification is a phenomena associated with rotary flow dividers, usually considered an undesirable phenomena to be guarded against and protected from, such as by incorporating pressure relief valves.

Although not in common usage, intensification from rotary flow dividers can be useful in some circumstances, such as when extra force from a cylinder or torque from a motor is required as a part of the duty cycle. Circuits useful is said circumstances are often referred to as high/low circuits or two speed circuits, and often involve double pumps.

A publication illustrating gerotor rotary flow dividers in intensification and multispeed circuits is the American Society of Agricultural Engineers Paper No. 911596 "Gerotor Rotary Flow Divider" by George Morgan, P.E., Sales Manager, White Hydraulics, Inc. presented at the 1991 International Winter Meeting sponsored by the American Society of Agricultural Engineers at the Hyatt Regency Chicago, Chicago, Ill., December, 1991 which is hereby incorporated by reference. The American Society of Agricultural Engineers is located at 2950 Niles Road, St. Joseph, Mich., 49085-9659, USA, Ph. (616) 429-0300, Fax: (616) 429-3852.

The state of the art uses flow dividers in intensification circuits where the flow divider is in constant operation. This contributes to system wear, wasted energy, and noise.

In multispeed circuits, where double or triple pumps are used, the pumps are in constant operation, which results in system wear, wasted energy, and noise. Also, pumps are relatively expensive as to compared to gerotor rotary flow dividers.

In previous patents awarded to applicant, U.S. Pat. No. 6,279,317 Morgan Aug. 28, 2001 and U.S. Pat. No. 6,438, 951 Morgan Aug. 27, 2002, a valve means was used to isolate a flow divider in regenerations circuits. While it may be argued that based on those patents and the above mentioned ASAE technical paper, the material in this application is obvious to anyone skilled in the art, applicant, who is very skilled in the art, can assure the examiner that it wasn't obvious to the applicant.

As will be seen from the subsequent description, the preferred embodiments of the present invention broadens the performance range of a hydraulic drive while conserving energy, reducing componentry wear, and even, in some cases, with less noise.

SUMMARY OF THE INVENTION

The present invention broadens the performance range of a hydraulic circuit by using a rotary flow divider to divide fluid flow with a portion of the fluid flow returning to a reservoir at low pressure and the balance of the flow intensified to a higher pressure in the hydraulic circuit when desired, with a valve means to isolate said flow divider from the hydraulic circuit when intensified pressure at a reduced flow is not desired.

DESCRIPTION OF THE PREFERRED EMBODIMENTS

Figure 1:
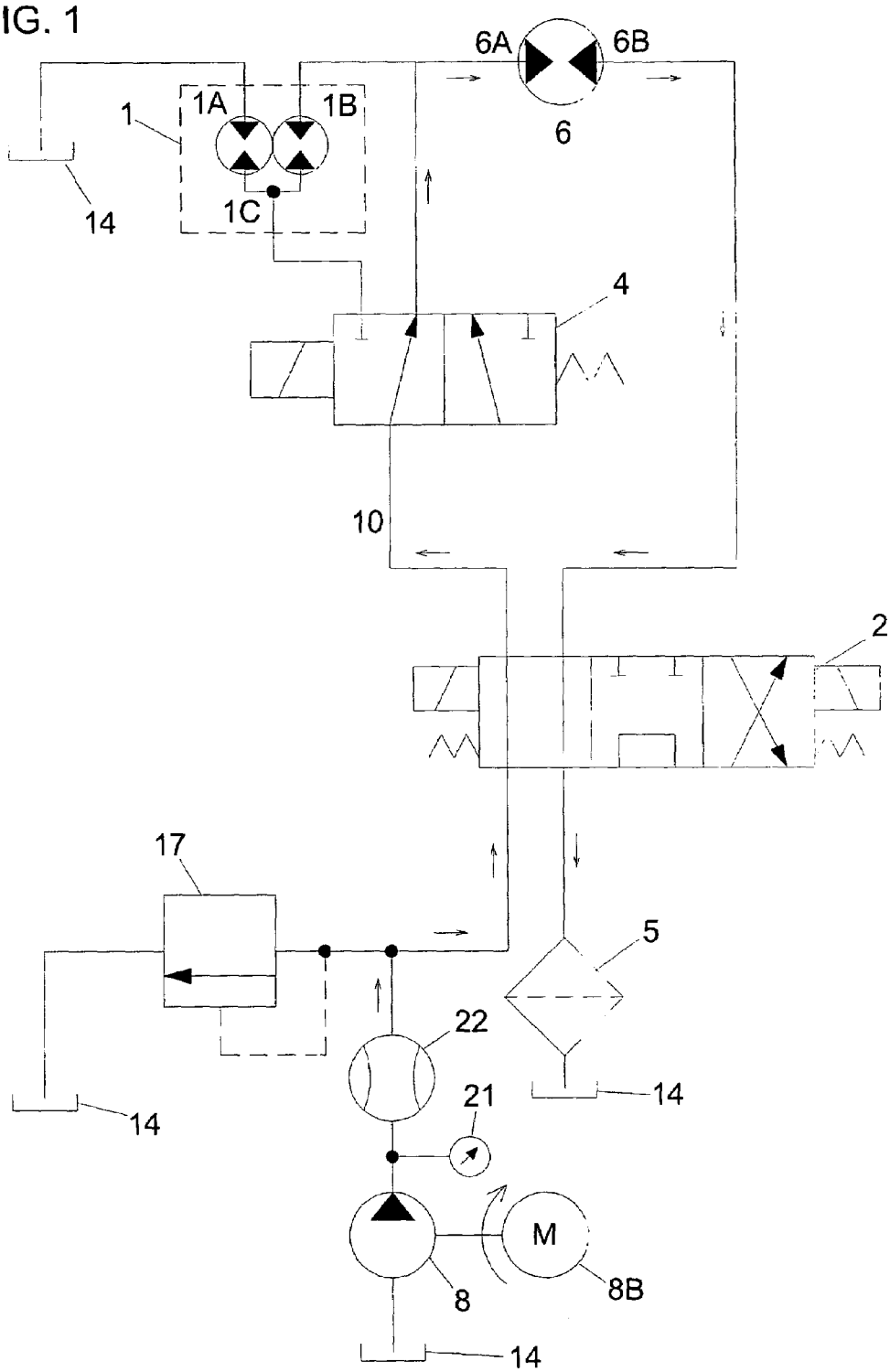
FIG. 1 illustrates the preferred embodiment of the present invention as applied to a hydraulic circuit that is an open loop hydraulic circuit, prior to actuation of a valve means to achieve fluid pressure intensification of fluid flow to a hydraulic actuator by means of a rotary flow divider.
Figure 2:
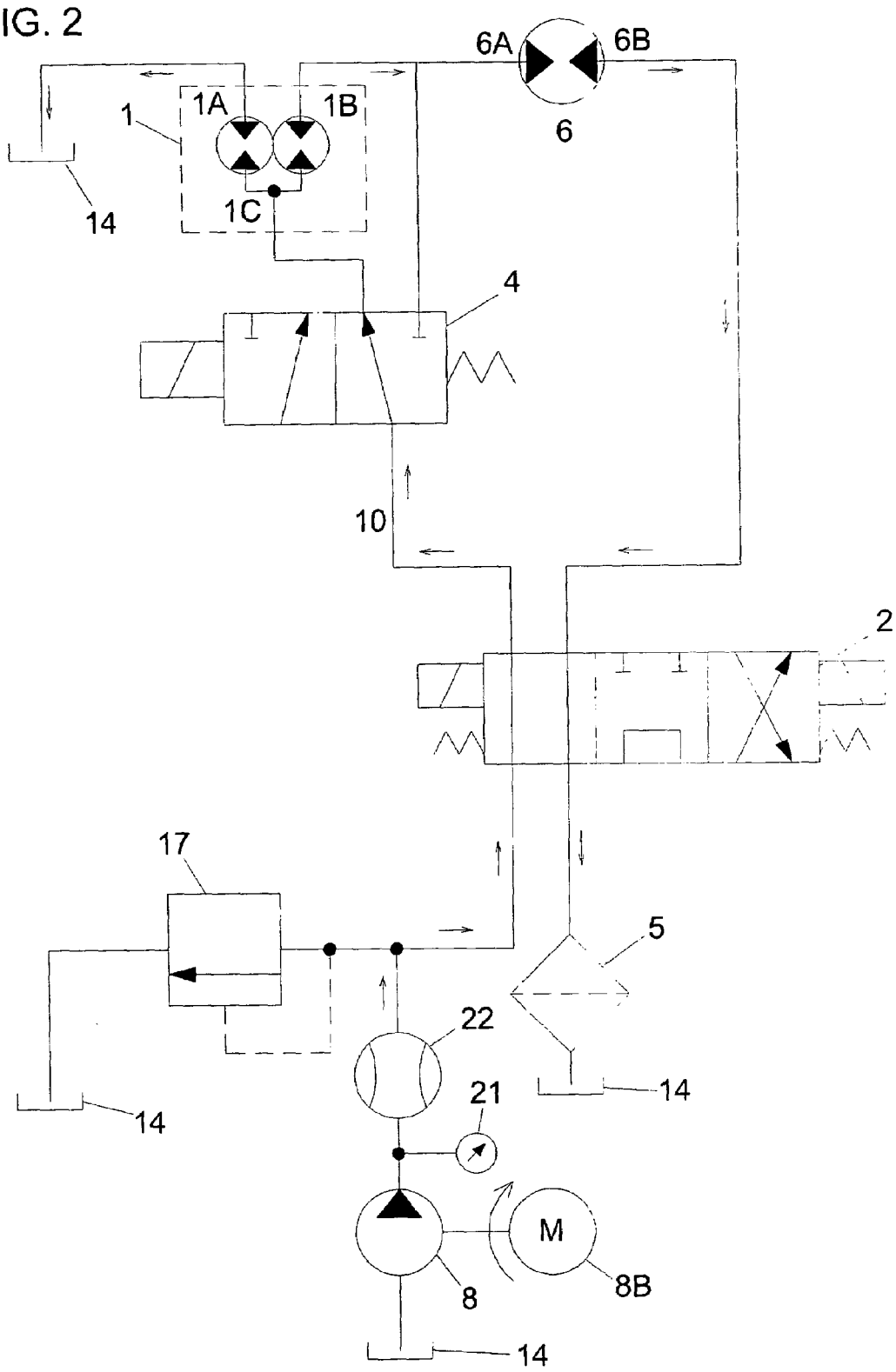
FIG. 2 illustrates the preferred embodiment of the present invention of FIG. 1 when said valve means is actuated to route fluid through the rotary flow divider which results in fluid pressure intensification of fluid flow to a hydraulic actuator.

FIGS. 1 and 2 illustrate the preferred embodiment of the present invention, a hydraulic intensification circuit 10 comprising a rotary flow divider 1 comprising an inlet 1C, a first section 1A and a second section 1B; a directional valve 2, a hydraulic pump 8 powered by a motor 8B; at least one hydraulic actuator 6 such as, but not restricted to, a motor, a linear actuator, or a rotary actuator, said at least one hydraulic actuator 6 comprising an inlet 6A and an outlet 6B; and a first valve means 4.

Also shown in FIGS. 1 and 2 are auxiliary items common to hydraulic circuits, such as, but not restricted to, a directional valve 2, a filter 5, a motor 8B such as, but not restricted to an electric motor, an air motor, or an engine; a reservoir 14; a pressure gauge 21; a flow meter 22; and a relief valve 17; While multiple reservoirs 14 are shown, this is an illustration convenience for a single reservoir 14, which would be the most common circumstance for said circuit 10.

Typically there is only one reservoir 14, but in a fluid power schematic it is a common practice to show multiple reservoirs 14 to simplify the schematic.

In the preferred embodiment of the present invention, the first valve means 4 is a solenoid operated spring return two position three way valve.

The first valve means 4 is in fluid communication with the outlet 6B of the at least one hydraulic actuator 6.

In the non-intensified mode illustrated in FIG. 1, the first valve means 4 is in a non-actuated state isolating said flow divider 1 from said pump 8 flow in the circuit 10. Fluid flow from the hydraulic pump 8 bypasses said flow divider 1. While some leakage is expected internally within said flow divider 1, this is not seen as a problem with rotary flow dividers such as the White ROLLER STATOR™ flow dividers manufactured by White Hydraulics, Inc. of Hopkinsville, Ky., a major supplier of gerotor hydraulic motors and flow dividers often referred to as gerotor flow dividers.

In the preferred embodiment of the present invention, said flow divider 1 is a rotary flow divider with orbiting gerotor elements which are known to the trade and available from the aforementioned White Hydraulics, Inc.

In FIG. 1 the directional valve 2 directs fluid flow as shown by directional arrow from the outlet port 6B of the at least one hydraulic actuator 6 so the fluid flows through the directional valve 2, which is in the non-actuated state, to the reservoir 14. The direction of fluid flow into the at least one hydraulic actuator 6 shown in FIG. 1 is arbitrarily selected as a forward direction.

In FIG. 2, the first valve means 4 is actuated which results in an intensified mode in the forward direction as illustrated. The fluid flow from the first section 1A of the flow divider 1 is dumped to the reservoir 14. As the first section 1A is mechanically connected to the second section 1B, a pressure drop across the first section 1A serves to turn the second section 1B into a pump, raising the pressure of the fluid as it flows across the section 1B. This is a phenomena known as intensification, which is known to the trade, and has been mentioned as background information and discussed in the prior art references.

If the first section 1A has equal flow to that of the second section 1B, then the resultant flow into said actuator 6 is approximately half the volume at approximately twice the pressure than would be the case if the first valve means had not been actuated, as was the case in FIG. 1.

Rotary flow dividers are available with sections of different displacement ratios which permits variations in flows and pressures. (Ref. the previously mentioned ASAE technical paper.)

Figure 3:
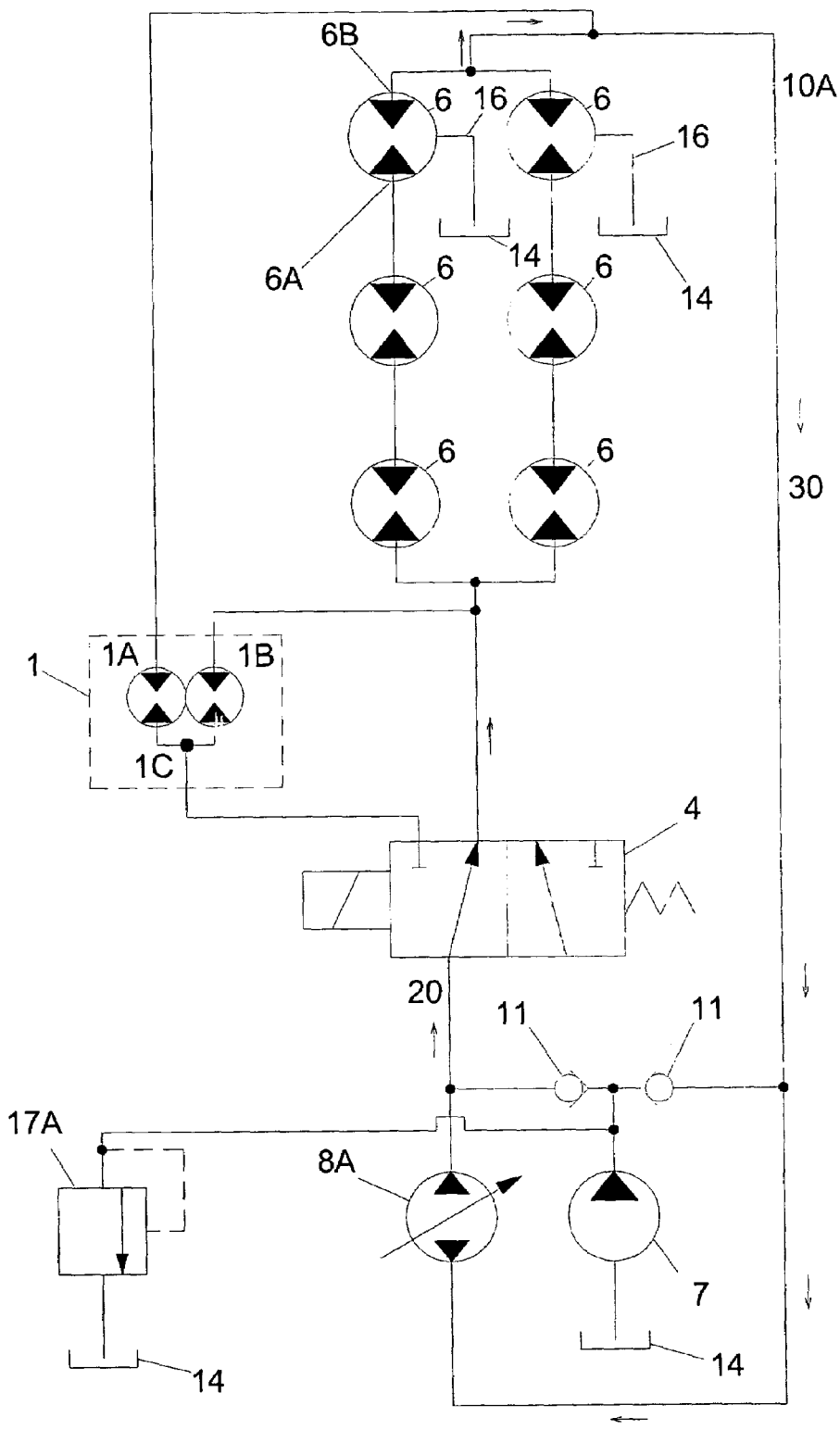
FIG. 3 illustrates the preferred embodiment of the present invention as applied to a hydraulic circuit that is a closed loop hydrostatic drive, prior to actuation of a valve means to achieve fluid pressure intensification of fluid flow to a hydraulic actuator by means of a rotary flow divider.
Figure 4:
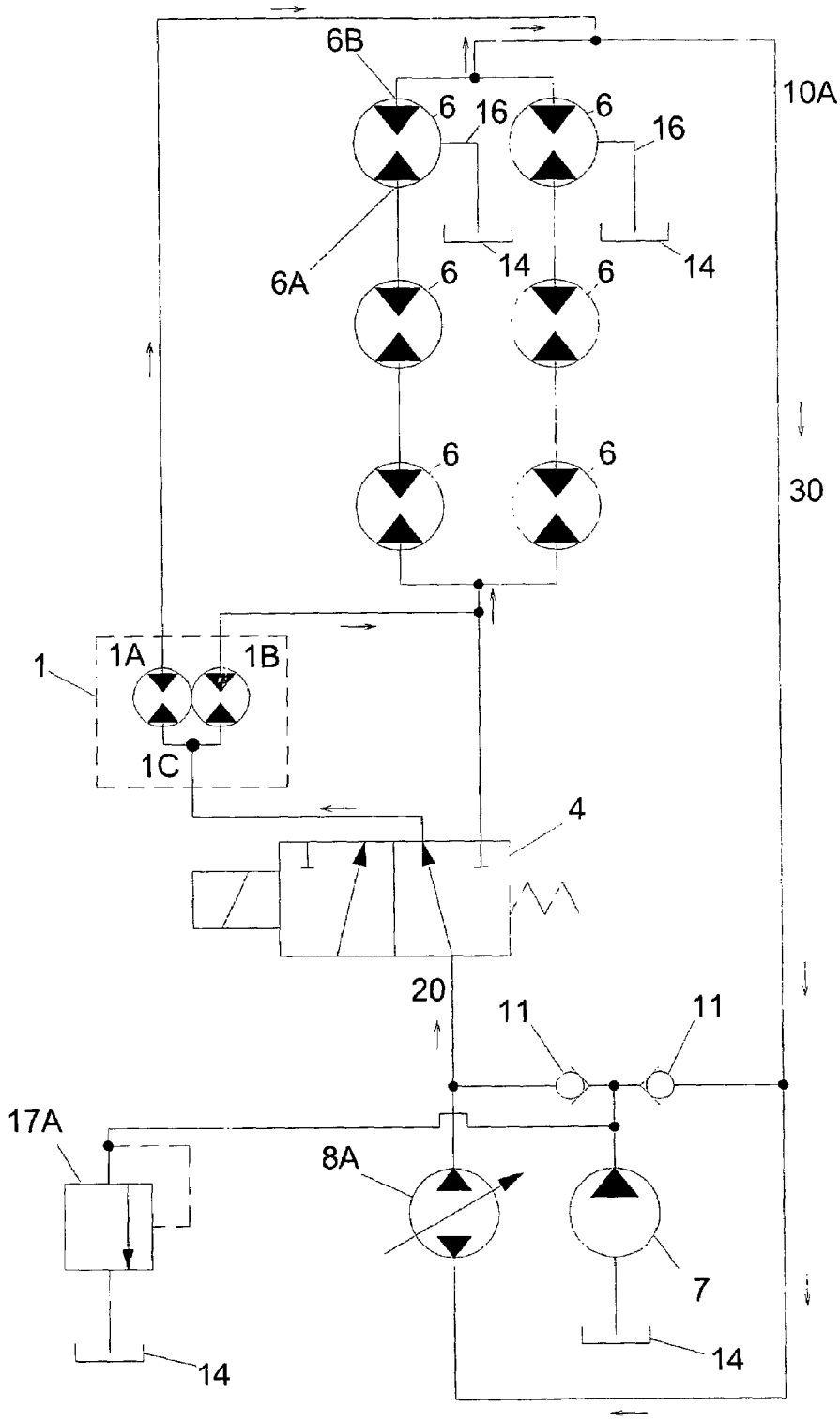
FIG. 4 illustrates the preferred embodiment of the present invention of FIG. 3 when said valve means is actuated to route fluid through the rotary flow divider which results in fluid pressure intensification of fluid flow to a hydraulic actuator.

FIGS. 3 and 4 illustrate an alternate preferred embodiment of the present invention as applied to a hydraulic circuit 10A that is known in the trade as a closed loop hydrostatic drive.

The hydraulic circuit 10A comprises the rotary flow divider 1 comprising the first section 1A, the second section 1B, and the inlet 1C; the valve means 4; at least one hydraulic actuator 6 comprising the inlet 6A and the outlet 6B; a fixed displacement charge pump 7; a variable displacement pump 8A; check valves 11; the reservoir 14; optional actuator case drains 16; a charge pump relief valve 17A; the variable displacement pump fluid output flow line 20; the return line 30 and a reservoir 14.

The hydraulic circuit 10A in FIGS. 3 and 4 differs from the hydraulic circuit 10 shown in FIGS. 1 and 2, in that instead of oil from the first section 1A of the rotary flow divider 1 being returned directly to the reservoir 14 as was the case for said circuit 10 as illustrated in FIGS. 1 and 2, in said circiuit 10A as illustrated in FIGS. 3 and 4, the oil from the first section 1A of the rotary flow divider 1 is routed to the return line 30. In FIGS. 3 and 4, the direction of fluid flow as indicated by arrows is defined as the forward direction. In the forward direction, said line 20 would be at a higher pressure than the return line 30.

When the valve means 4 is in the unactuated, or at rest, condition as shown in FIG. 3, said pump 8A, which is shown as a bi-directional variable displacement pump, can reverse fluid flow, and the circuit 10A operate in reverse. However, this is not true in the case of FIG. 4, when the valve means 4 is actuated, in that the circuit 10A cannot be actuated in reverse.

Although the description above contains many specificities, these should not be construed as limiting the scope of the invention but as merely providing illustrations of some of the presently preferred embodiments of this invention.

The directional valve 2 is shown in FIGS. 1 and 2 as having a center position. Not all directional valves have a center position. Also, the illustration indicates the directional valve 2 has what is called a cylinder spool, i.e. in the centered position it has blocked work ports. There are a number of different types of spools that would serve the purpose, so the intent is not to restrict this description to a valve with a cylinder spool. In some cases a motor spool which would be one with the work ports connected would be preferred. While the directional valve 2 is shown as a solonoid operated spring centered valve, there are a variety of valve operators available such as, but not restricted to, pneumatic, hydrualic, cam, and manual.

Also, the first valve means 4 is shown as a solenoid operated valve 4 with spring return. Similar valves with other types of actuation, such as, but not restricted to, cam, pneumatic, hydraulic, or manual would also serve the same purpose.

Also, the term fluid is intended to cover any fluid suitable for serving its intended purpose in the preferred embodiment of the invention described. There are many different types of fluids currently used or being developed for hydraulic drives, such as, but not restricted to, hydraulic oils, engine oils, synthetic oils, vegetable base oils, even water with and without additives.

The directional valve 2 may be used to reverse the direction of the flow, to reverse the direction of said actuator 6. For best results, if the first valve means 4 is not returned to the unactuated state as shown in FIG. 1, installing the reservoir 14 above the flow divider 1 might preclude cavitation in the section 1A.

Said pumps 8 and 8A each serve as a source of fluid flow in their respective circuits 10 and 10A. An equivalent source of fluid flow would serve the same purpose, such as, but not restricted to flow from a valve means that is a part of another fluid circuit.

An alternate source of fluid flow could be a high pressure line of a closed loop hydrostatic drive, in which case, when the first valve means 2 is sending fluid to the rotary flow divider 1, the fluid from the first section 1A of the flow divider would be returned to a return line of the hydrostatic drive, said return line serving as a reservoir 14. In FIGS. 3 and 4, in the forward direction, said flow line 20 serves as the high pressure line of a closed loop hydrostatic drive while the return line 30 serves as the return line of the hydrostatic drive.

Also, in the trade, the terms "hydraulic circuit" and "fluid power circuit" are used interchangeably and have the same meaning in this application.

It will be obvious to those skilled in the art that modifications may be made to the embodiments described above without departing from the scope of the present invention. Thus the scope of the invention should be determined by the appended claims in the formal application and their legal equivalents, rather than by the examples given.

I claim:

1. A fluid power circuit comprising:

a) a source of fluid flow at a first pressure;

b) a valve means connected to said source of fluid flow;

c) a rotary flow divider;

d) an actuator connected to a fluid outlet of said rotary flow divider;

wherein said valve means includes a first position wherein substantially all the fluid flow is supplied to the actuator at the first pressure and a second position wherein a first portion of the fluid flow is diverted from said actuator and a remaining portion of said fluid flow is supplied to said actuator at a second pressure, said second pressure higher than said first pressure.

2. The fluid flow circuit of claim 1 wherein said first portion is diverted to a reservoir.

3. The fluid power circuit of claim 1 wherein the source of fluid flow is a pump and wherein said first portion of said fluid is diverted to a low pressure return line to the inlet of said pump when said valve is in said second position.

4. A fluid power circuit comprising:

a rotary flow divider having an inlet connected to a source of hydraulic fluid under pressurized flow, said rotary flow divider having a first outlet connected to a low pressure means to return fluid to an inlet of said source of hydraulic fluid pump; said rotary flow divider including a second outlet connected to a driven circuit; said source of hydraulic pressure including a valve having a first position to selectively bypass said rotary flow divider to supply said hydraulic fluid directly to said driven circuit and a second position to supply hydraulic fluid to said rotary flow divider.

5. The fluid power circuit of claim 4 wherein fluid flow through said second outlet of said rotary flow divider is at a pressure higher than that supplied directly to the driven circuit when said valve is in said first position.

* * * * *